US005883466A

United States Patent [19]

Suyama et al.

[11] Patent Number: 5,883,466

[45] Date of Patent: Mar. 16, 1999

[54] ELECTRON TUBE

[75] Inventors: Motohiro Suyama; Suenori Kimura; Norio Asakura; Ken Hirano; Yoshihiko Kawai; Yutaka Hasegawa; Tetsuya Morita, all of Hamamatsu, Japan

[73] Assignee: Hamamatsu Photonics K.K., Hamamatsu, Japan

[21] Appl. No.: 891,840

[22] Filed: Jul. 14, 1997

[30] Foreign Application Priority Data

Jul. 16, 1996 [JP] Japan ..... 8-186387
Jul. 16, 1996 [JP] Japan ..... 8-186392

[51] Int. Cl.[6] ..... H01J 43/12

[52] U.S. Cl. ..... 313/542; 313/544; 313/532; 250/398; 250/207; 250/214 VT

[58] Field of Search ..... 313/542, 384, 313/530, 544, 532, 379, 537; 250/207, 214 VT, 398, 399

[56] References Cited

U.S. PATENT DOCUMENTS

| | | | |
|---|---|---|---|
| 3,705,321 | 12/1972 | Wolfgang | 313/65 |
| 4,286,148 | 8/1981 | Kamps et al. | 313/534 X |
| 4,733,129 | 3/1988 | Kinoshita et al. | 323/542 X |
| 4,839,569 | 6/1989 | Dallin, II | 313/313 |
| 5,120,949 | 6/1992 | Tomasetti | 250/207 |
| 5,146,296 | 9/1992 | Huth | 357/19 |
| 5,374,826 | 12/1994 | LaRue et al. | 250/397 |
| 5,475,227 | 12/1995 | LaRue | 250/397 |
| 5,498,926 | 3/1996 | Kyushima et al. | 313/532 X |
| 5,654,536 | 8/1997 | Suyama et al. | 313/532 X |

FOREIGN PATENT DOCUMENTS

| | | |
|---|---|---|
| 0 602 983 | 6/1994 | European Pat. Off. . |
| 0 714 117 | 5/1996 | European Pat. Off. . |
| 57-46453 | 3/1982 | Japan . |
| 6-243795 | 9/1994 | Japan . |
| 6-318447 | 11/1994 | Japan . |
| 8-148113 | 6/1996 | Japan . |
| 1 328 772 | 9/1973 | United Kingdom . |
| 2 041 635 | 2/1979 | United Kingdom . |

OTHER PUBLICATIONS

Patent Abstracts Of Japan, vol 018, No 139 (E–1519), Mar. 8, 1994, & JP 05 325880 A, Dec. 10, 1993.

Basa et al, "Test Results of the First Proximity Focused Hybrid Photodiode Detector Prototypes", Nuclear Instruments and Methods in Physics Research, A330 North–Holland, pp. 93–99; Dec. 1993.

Johansen et al, "Operational Characteristics of an Electron–Bombarded Silicon–Diode Photomultplier Tube", Nuclearl Instruments and Methods in Physics Research, A326 North–Holland, pp. 295–298; Dec. 1993.

Fertin et al, "Reverse Epitaxial Silicon Diode for Hybrid Photomultiplier Tube", IEE Trans. Nucl. Sci., NS–15 pp. 179–189; Dec. 1968.

van Geest et al, "Hybrid Phototube With Si Target", Nuclear Instruments and Methods in Physics Research A310 North–Holland, pp. 261–266; Dec. 1991.

*Primary Examiner*—Ashok Patel
*Attorney, Agent, or Firm*—Pillsbury Madison & Sutro LLP

[57] ABSTRACT

The present invention relates to an electron tube includes, at least, a cathode electrode and a face plate having a photocathode which are arranged at one end of a body, and a stem arranged at the other end of the body for defining the position of an electron entrance surface where the electron emitted from the photocathode reaches. The object of the present invention is to provide an electron tube which can reduce its size and has a structure for improving the workability in its assembling process. In particular, the electron tube in accordance with the present invention comprises a bonding ring, provided between the face plate and the cathode electrode, for bonding the face plate and the cathode electrode together. The bonding ring is made of a metal material selected from the group consisting of In, Au, Pb, alloys containing In, and alloys containing Pb.

21 Claims, 11 Drawing Sheets

ELECTRON TUBE

BACKGROUND OF THE INVENTION

1. Field of the Invention

The present invention relates to an electron tube utilized as a photodetector for quantitatively measuring weak light. In particular, the present invention relates to an electron tube equipped with a sensing device having an electron entrance surface such as a semiconductor device for multiplying and outputting electrons emitted from a photocathode.

2. Related Background Art

There have conventionally been known electron tubes in which electrons emitted from a photocathode are accelerated and converged by an electron lens and then are made incident on a semiconductor device to yield a high gain. Such electron tubes are disclosed, for example, in U.S. Pat. No. 5,120,949, U.S. Pat. No. 5,374,826, and S. Base et al., "Test Results of the First Proximity Focused Hybrid Photodiode Detector Prototypes," *Nuclear Instruments and Methods in Physics Research*, A330 (1993), 93–99. In particular, the above-mentioned Base reference discloses an electron tube such as that shown in FIG. 1. This electron tube has an electrical insulating bulb 102 which secures electrical insulation between an anode 100 and a cathode electrode 101. The inner diameter of the cathode electrode 101 is made greater than that of the bulb 102, whereby a photocathode 103 has a large area, allowing a semiconductor device 104 to have an increased effective area (e.g., 100 $mm^2$). Accordingly, it can be seen that the electron tube shown in FIG. 1 has a large size. The cathode electrode 101 employed in this electron tube is constituted by two pieces of cylindrical metal members 101*a* and 101*b* having inner diameters different from each other disposed concentrically with a gap therebetween.

SUMMARY OF THE INVENTION

Having studied the above-mentioned prior art, the inventors have found the following problems to be overcome. The cathode electrode 101 of the electron tube shown in FIG. 1 can be configured into various sizes and forms as two pieces of cylindrical metal members 101*a* and 101*b* are combined together. Though it is suitable for a large electron tube since a gap must be formed between these metal members 101*a* and 101*b*, such a gap is hard to secure in a small electron tube (with a diameter of about 10 mm, for example). Also, in order to assemble such a cathode electrode 101, each of two planar sheets must be pressed and then sealed by welding or the like into a cylindrical form, thereby yielding a low efficiency in the assembling operation.

It is thus an object of the present invention to provide an electron tube which can reduce its size and has a structure for improving the workability in its assembling process.

In order to achieve this object, the electron tube in accordance with the present invention comprises, at least, a body having a first opening and a second opening opposing the first opening; a face plate which is arranged at the first opening side of the body and on which a photocathode for emitting a photoelectron in response to incident light is disposed; a stem, arranged at the second opening side of the body, for defining a distance between the photocathode and an electron entrance surface (corresponding to the electron entrance surface of an avalanche photodiode or the like) opposing the photocathode; a cathode electrode arranged at the first opening side of the body and positioned between the body and the face plate; and a bonding member, provided between the face plate and the cathode electrode, for bonding the face plate and the cathode electrode together.

In particular, the bonding member is made of a metal material selected from the group consisting of In, Au, Pb, alloys containing In, and alloys containing Pb. In the electron tube in accordance with the present invention, in order to allow its size to decrease, after the step for forming the photocathode (heating to about 300° C.), the cathode electrode and the body are bonded together in an atmosphere at a temperature much lower than that in the photocathode-forming step. Accordingly, as the material for the bonding member, materials which can sufficiently deform at a pressure of about 100 kg in the atmosphere at room temperature are preferable, whereas metals such as aluminum are unfavorable.

The cathode electrode has a through-hole for transmitting therethrough the photoelectron from the photocathode toward the electron entrance surface. The electron tube comprises a welded electrode arranged at the second opening side of said body and positioned between the body and the stem. This welded electrode also has a through-hole for transmitting therethrough the photoelectron transmitted through the through-hole of the cathode electrode toward the electron entrance surface.

The electron tube in accordance with the present invention may further comprise an anode having a through-hole for transmitting therethrough the photoelectron transmitted through the cathode electrode (first embodiment). This anode is supported by the welded electrode such that at least part of the anode is positioned between the cathode electrode and the electron entrance surface, thereby constituting an electron lens together with the cathode. In the first embodiment, it is preferred that the through-hole of the anode has a smaller area than the electron entrance surface. It is due to the fact that, when a photoelectron from the photocathode reaches the surroundings of the electron entrance surface, the device is deteriorated or charged. Alternatively, a part of the welded electrode may be configured to function as the anode (second embodiment). Also in the second embodiment, it is preferred that the through-hole of the anode has a smaller area than the electron entrance surface.

In addition, the welded electrode comprises a portion to be resistance-welded to the stem. The stem has a mounter section, projecting toward the photocathode, for holding a semiconductor device.

In the electron tube in accordance with the present invention, light incident on the face plate from the outside is converted into electrons by the photocathode. While the orbit of the electrons is converged by an electron lens effect formed by the cathode electrode and anode cooperating together, the electrons reach the electron entrance surface of the semiconductor device or the like. Here, the cathode electrode has a cylindrical form and can be made easily by any of various integral-molding methods such as press molding, injection molding, or cutting. Also, a small cathode electrode can easily be materialized when required, allowing the electrode to further decrease its size. Since each of the cathode electrode, body, and welded electrode is formed like a ring, they can easily be mounted on each other concentrically. Accordingly, in order to form a vacuum case, the operation for assembling the case is facilitated. As the electron tube is made smaller, the present invention can satisfy a strong demand in the fields of high energy and medical instruments for using 1,000 to 10,000 pieces of electron tubes arranged in a limited space. Also, when a ring-shaped member made of indium is disposed between the cathode electrode and face plate in the case, and the face plate (provided with a photocathode beforehand) and the cathode electrode are pressed against each other while a high pressure of about 100 kg is applied thereto in a vacuumed transfer apparatus (within a vacuum chamber) and a vacuum region can easily be formed within the electron tube. Accordingly, it is unnecessary for the case to be provided with an exhaust tube, and a large number of electron tubes can be produced within the transfer apparatus.

In this case, it is preferable that the cathode electrode, the body, and the cylindrical main part of the welded electrode have substantially the same cross-sectional form. In such a configuration, the outer face of the case can be made free of irregularities, thereby yielding a simple form without roughness. Accordingly, a number of electron tubes can be arranged densely. Also, the electron tube can become easy to handle, while yielding a structure which is tolerant to a pressure as high as 150 kg.

Also, it is preferable that the inner peripheral wall face of the cathode electrode be positioned on the inside of the inner peripheral wall face of the body. In other words, the inner diameter of the cathode electrode is preferably smaller than that of each of the first and second openings in the body. In this configuration, stray electrons generated at unintentional places on the photocathode side can be prevented from impinging on the body. Accordingly, the body is kept from being charged upon impingement of the stray electrons thereon and thereby influencing the electron orbit.

The welded electrode is preferably connected to the stem by resistance welding. In this case, as the stem is resistance-welded to the welded electrode of the case, the second opening of the case can easily be closed with the stem.

One end of the cylindrical main part of the welded electrode is provided with a first flange section (first edge section) projecting outward, whereas the other end of the cylindrical main part is provided with a second flange section (second edge section) projecting inward from the inner wall of the body, and the outer periphery of the stem is provided with a cutout edge section which is secured to the first flange section of the welded electrode. In this configuration, the stem can be attached to the welded electrode by a simple assembling operation in which the first flange section of the welded electrode is resistance-welded to the cutout edge section of the stem. Further, the attachment of the case (including the cathode electrode, body, and welded electrode) to the stem can be improved. Also, since the second flange section of the welded electrode projects into the electron tube, the second flange section itself can function as an anode (second embodiment). Alternatively, an anode having a given form may simply be secured to the second flange section by welding or the like (first embodiment).

Further, in the electron tube in accordance with the present invention (third and fourth embodiments), the body comprises at least two insulating members, each of which has a through hole extending from the photocathode toward the electron entrance surface, and at least one conductive member provided between, of the insulating members, those adjacent to each other. The conductive member has a through-hole extending from the first opening toward the second opening. The body of the electron tube is constituted by the insulating and conductive members alternately mounted on each other. Obtained in this configuration is a case in which the cathode electrode is attached to one end (end portion where the first opening is positioned) of the body, whereas the welded electrode is attached to the other end (end portion where the second opening is positioned) of the body.

In addition, in order to control the photoelectron emitted from the photocathode and prevent the inner wall of the insulating members from being charged, it is preferable that the through-hole of the conductive member has a smaller area than the through-hole of each insulating member.

Namely, the inner peripheral wall face of the cathode electrode is positioned on the inside of the inner peripheral wall face of the insulating members of the body, whereas the conductive member (intermediate electrode) projects inward from the inner peripheral wall face of the insulating members of the body. In this configuration, stray electrons generated at unintentional places on the photocathode side can be prevented from impinging on the insulating members of the body. Accordingly, the insulating members are kept from being charged upon impingement of the stray electrons thereon and thereby influencing the electron orbit.

Also, it is preferable that voltages supplied to the cathode electrode and the photocathode be the same, voltages supplied to the anode (or a part of the welded electrode) and the welded electrode be the same, and a predetermined voltage not lower than that supplied to the cathode electrode but not higher than that supplied to the anode be supplied to the intermediate electrode. In this configuration, dielectric breakdown does not occur even when a strong negative voltage is applied to the photocathode.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

DESCRIPTION OF THE PREFERRED EMBODIMENTS

In the following, embodiments of the electron tube in accordance with the present invention will be explained with reference to FIGS. 2 to 12.

Figure 1:
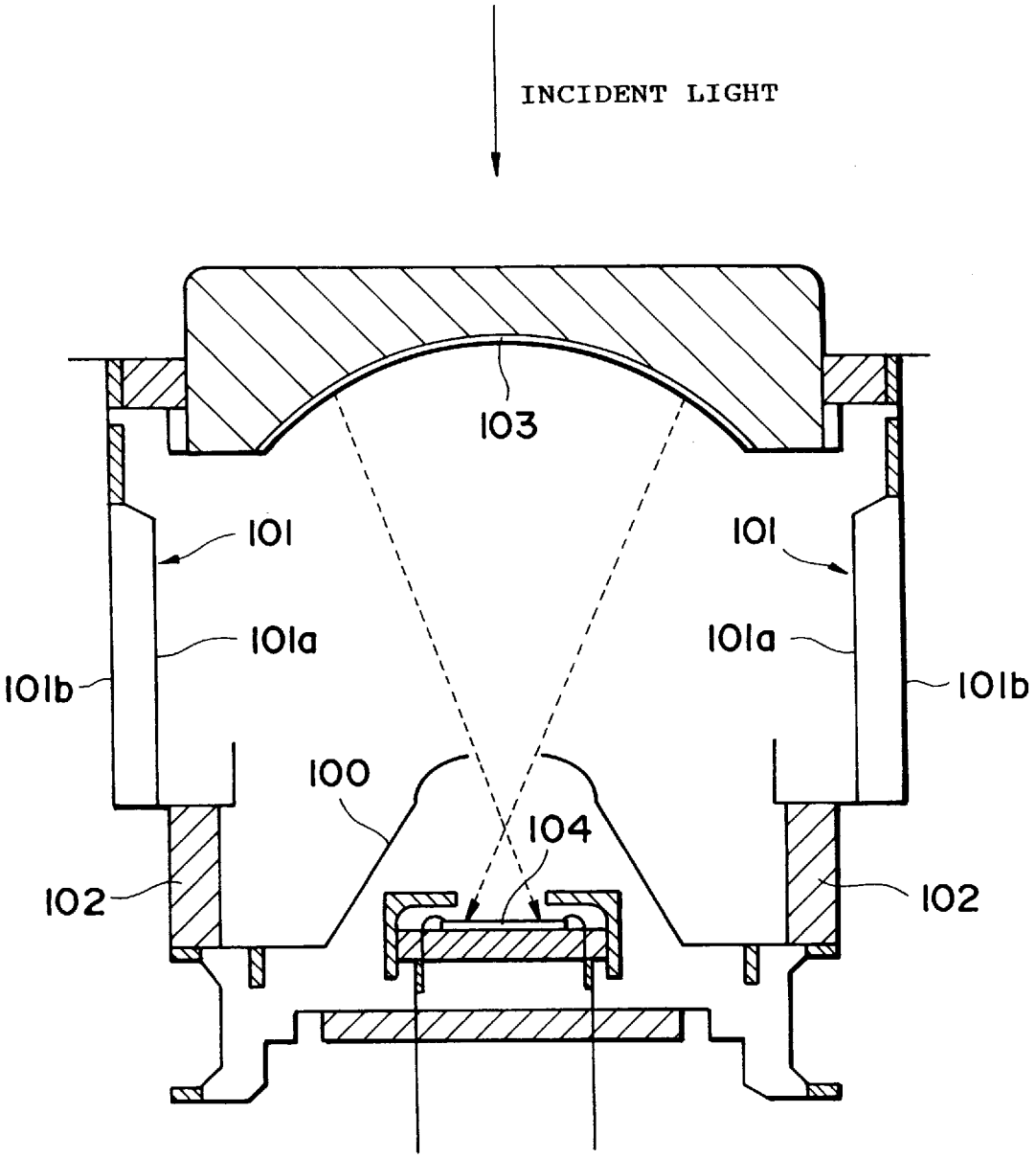
FIG. 1 is a view showing a cross-sectional configuration of a conventional electron tube.
Figure 2:
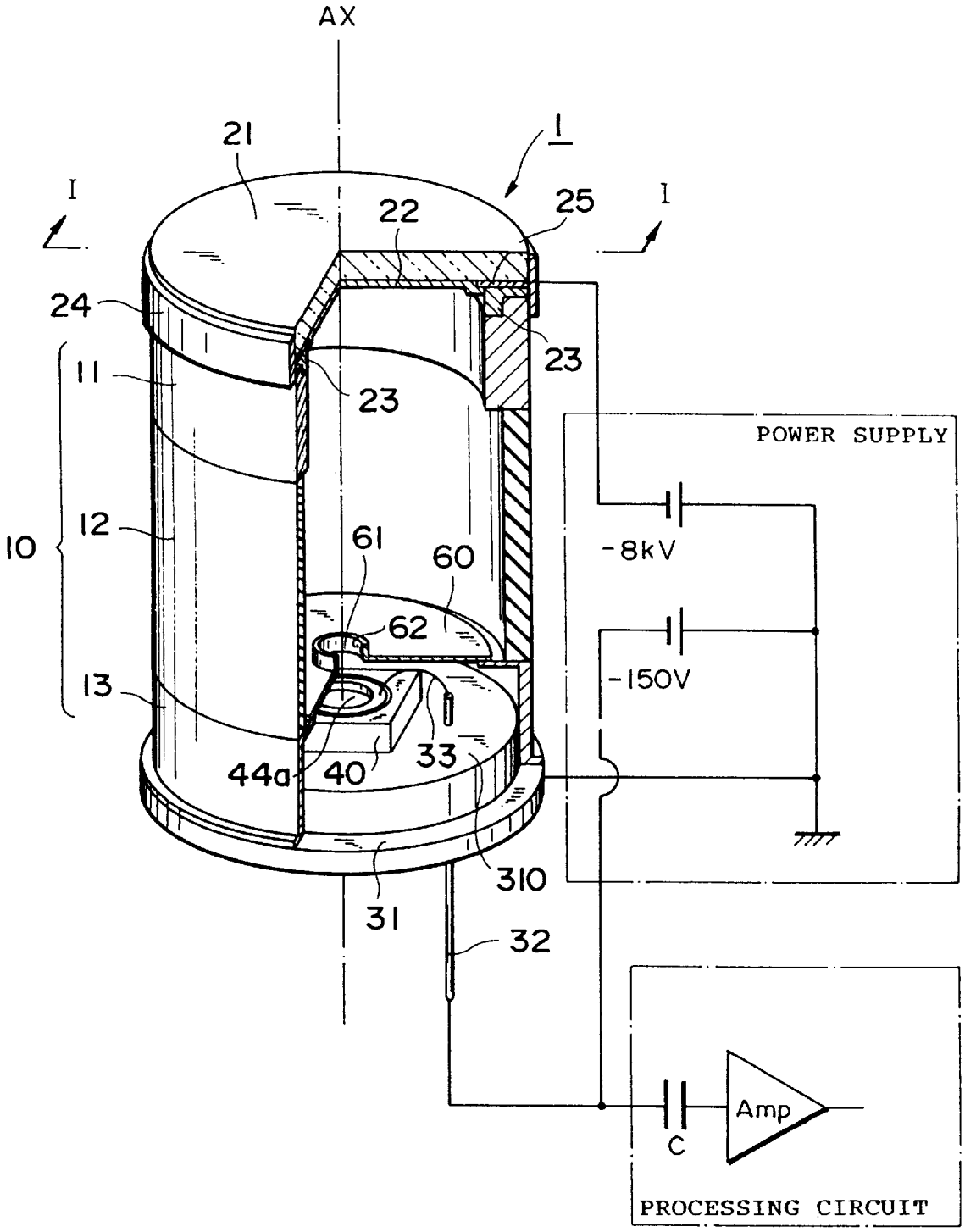
FIG. 2 is a perspective view showing a partial cross-sectional configuration of an electron tube in accordance with the present invention (first embodiment)
Figure 3:
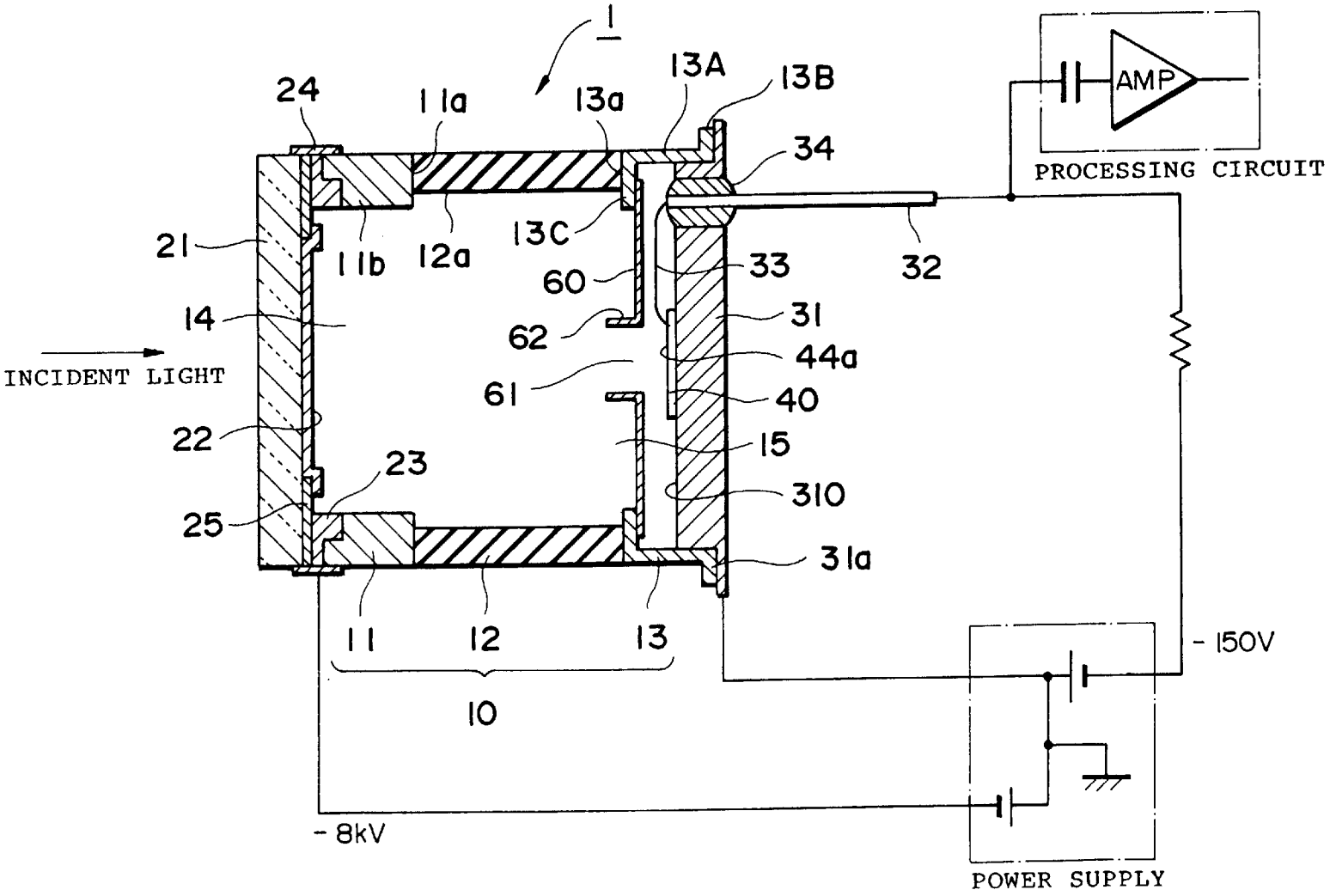
FIG. 3 is a view showing a cross-sectional configuration of the electron tube in accordance with the first embodiment of the present invention taken along line I—I in FIG. 2.

FIG. 2 is a perspective view showing a partial cross section of an electron tube 1 in accordance with a first embodiment of the present invention. FIG. 3 is a cross-sectional view showing the configuration of the electron tube 1 in accordance with the first embodiment taken along line I—I in FIG. 2. As shown in FIGS. 2 and 3, the electron tube 1 has a cylindrical case 10. The case 10 is constituted by a ring-shaped cathode electrode 11, which is made of a highly conductive covar metal by any of various integral-molding methods such as press molding, injection molding, or cutting; a ring-shaped body 12 made of an electrical insulating material (e.g., ceramics); and a ring-shaped welded electrode 13 made of a covar metal. These members 11, 12, and 13 are mounted on each other with their center axes AX coinciding with each other. While the body 12 is disposed between the cathode electrode 11 and the welded electrode 13, one end of the body 12 (on the side of a first opening 14) is butted against a flat end face 11*a* of the cathode electrode 11 and then is secured thereto by brazing or the like. The other end of the body 12 (on the side of a second opening 15) is butted against a flat end face 13*a* of the welded electrode 13 and then is secured thereto by brazing or the like. Accordingly, the case 10 includes the cathode electrode 11, the body 12, and the welded electrode 13, which are easily united together by brazing.

Further, the cathode electrode 11, the body 12, and a cylindrical main part 13A of the welded electrode 13 have substantially the same cross-sectional form (e.g., circular form having a diameter of 14 mm here). Accordingly, the outer face of the case 10 can be made free of irregularities, yielding a simple form without roughness. As a result, obtained is an electron tube which is easy to handle, and a number of such electron tubes can be arranged densely even in a narrow space. Also, thus obtained electron tube has a structure which is tolerant to a high pressure. Here, the ring-like cathode electrode 11, the body 12, and the welded electrode 13 may have a polygonal cross-sectional form.

An inner peripheral wall face 11*b* of the cathode electrode 11 is positioned on the inside of an inner wall face 12*a* of the body (insulating member) 12, whereby the inner diameter of the cathode electrode 11 is made smaller than that of the insulating member 12. In other words, the through-hole of the cathode electrode 11 has a smaller area than that of each of the first and second openings in the body 12. Accordingly, stray electrons generated at unintentional places on the side of a photocathode 22, which will be explained later, can be prevented from impinging on the body 12. Consequently, the body 12 is kept from being charged upon impingement of the stray electrons thereon and thereby influencing the electron orbit. Here, each of the through-holes 11*b* and 12*a* has a circular cross section. The inner diameters of the cathode electrode 11 and body 12 are respectively 10 mm and 11 mm, for example. The through-holes 11*b* and 12*a* may have either identical or different cross-sectional forms and may be either circular or polygonal. Here, the length of the cathode electrode 11 is preferably 3.5 mm, whereas the length of the body 12 is preferably 6.5 mm.

Firmly attached to the cathode electrode 11 in the case 10 is a face plate 21 made of glass which transmits light therethrough. The face plate 21 has a photocathode 22 on the inner face and is disposed at one end of the case 10 (on the side of the first opening 14 in the body 12). After the photocathode 22 is made, the face plate 21 is integrated with the cathode electrode 11 by way of a bonding member (bonding ring) 23 made of a metal material selected from the group consisting of In, Au, Pb, alloys containing In, and alloys containing Pb. Disposed at the peripheral portion of the photocathode 22 is an electrode 25 made of a thin film of chromium for electrically connecting together the photocathode 22 and the bonding member 23 (referred to as "indium ring" hereinafter) containing indium. The inner diameter of the electrode 25, i.e., 8 mm, defines the effective diameter of the photocathode 22. The indium ring 23 is formed so as to project from the inner side face of a hollow cylindrical auxiliary member 24 (conductive material). When the indium ring 23 and the face plate 21 are successively disposed on the cathode electrode 11, and then the cathode electrode 11 and the face plate 21 are pressed against each other at a high pressure of about 100 kg, the indium ring 23 deforms and functions as an adhesive, whereby the face plate 21 is integrated with the case 10. The auxiliary member 24 functions not only to prevent the indium ring 23 deformed upon a predetermine pressure applied thereto from projecting to the outside but also as an electrode for applying a predetermined voltage to the photocathode 22.

As the material for the adhesive member 23, since the cathode electrode 11 and the face plate 21 having the photocathode 22 are bonded together after the manufacturing process for the photocathode 22, materials which can sufficiently deform at a pressure of about 100 kg in the atmosphere at room temperature are preferable, whereas hard metals such as aluminum are unfavorable.

Firmly attached to the welded electrode 13 in the case 10 is a disk-shaped stem 31 made of a conductive material (e.g., covar metal). The stem 31 is disposed at the other end of the case 10 (on the side of the second opening 15 in the body 12). Here, one end of the cylindrical main part 13A of the welded electrode 13 is provided with a circular first flange section 13B projecting outward so as to be utilized for joining with the stem 31, whereas the other end of the cylindrical main part 13A of the welded electrode 13 is provided with a circular second flange section 13C projecting inward so as to be utilized for joining with the body 12. Formed at the outer periphery of the stem 31 is a cutout edge section 31*a* for attaching to the first flange section 13B. Accordingly, the welded electrode 13 and the stem 31 can easily be joined together by a simple assembling operation in which the first flange section 13B of the welded electrode 13 is resistance-welded to the cutout edge section 31*a* of the stem 31. Also, in this configuration, the attachment of the case 10 to the stem 31 is quite improved. A lead pin 32 insulated by a glass member 34 is secured to the stem 31. The electron tube 1 is integrally formed by the case 10, the face plate 21, and the stem 31, such that its inside is kept in a vacuum state.

Figure 4:
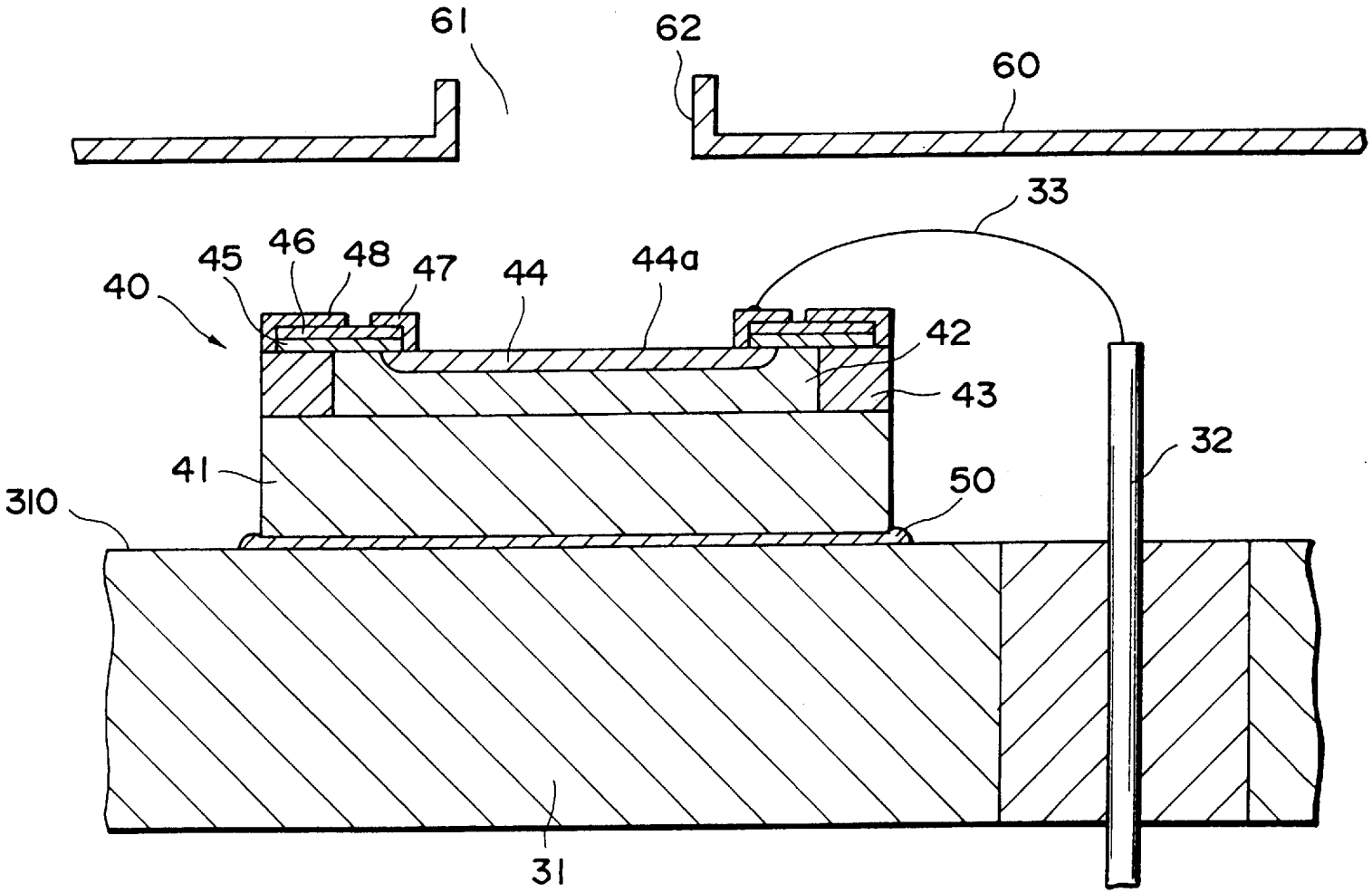
FIG. 4 is a view showing a cross-sectional configuration of a semiconductor device (APD) in the electron tube in accordance with the first embodiment shown in FIG. 3.

Further, as shown in FIG. 4, a semiconductor device 40 operating as an APD (avalanche photodiode) is secured onto a mounting surface 310 of the stem 31 by way of a conductive adhesive 50. The semiconductor device 40 comprises, as a substrate material, a silicon substrate 41 containing a high concentration of an n-type dopant. Formed at the center portion of the substrate 41 is a disk-shaped p-type carrier-multiplying layer 42. Formed at the outer periphery of the carrier-multiplying layer 42 is a guard ring layer 43 having the same thickness as that of the carrier-multiplying layer 42 and containing a high concentration of a n-type dopant. Formed on the surface of the carrier-multiplying layer 42 is a breakdown-voltage control layer 44 containing a high concentration of a p-type dopant. The surface of the breakdown-voltage control layer 44 is formed as an electron entrance surface 44*a*. An oxide film 45 and a nitride film 46 are formed so as to link the peripheral portion of the breakdown-voltage control layer 44 and the guard ring layer 43 together. Disposed on the outermost surface of the semiconductor device 40 are an electrode 47 formed by circularly deposited aluminum for supplying an anode potential to the breakdown-voltage control layer 44 and a peripheral electrode 48 for connecting with the guard ring layer 43. The peripheral electrode 48 is spaced from the electrode 47 with a predetermined distance therebetween. Preferably, the electron entrance surface 44*a* is positioned within the opening of the entrance surface electrode 47 and has a diameter of about 3 mm.

The n-type silicon substrate 41 of the semiconductor device 40 is secured to the stem 31 by way of the conductive adhesive 50. As the conductive adhesive 50 is utilized, the stem 31 and the n-type substrate 41 are electrically connected to each other. By way of a wire 33, the electrode 47 is connected to the lead pin 32 insulated from the stem 31.

As shown in FIGS. 2 to 4, in the electron tube 1 in accordance with the present invention, a planar anode 60 is disposed between the semiconductor device 40 and the photocathode 22. The outer peripheral end portion of the anode 60 is secured to the second flange section 13C of the welded electrode 13. Also, the anode 60 is positioned in the body 12 on the side of the second opening 15 and is formed by a pressed thin stainless sheet having a thickness of 0.3 mm. Preferably, the distance between the anode 60 and the semiconductor device 40 is 1 mm.

An opening section 61 is formed at the center of the anode 60, i.e., at the region opposing the electron entrance surface 44*a* of the semiconductor device 40. Further, integrally formed with the anode 60 is a cylindrical collimator section (collimator electrode) 62 projecting toward the photocathode 22 so as to surround the opening section 61. The collimator section 62 is disposed so as to project toward the photocathode 22 and surround the opening section 61. Preferably, the collimator section 62 has an inner diameter of 2.5 mm and a height of 1.5 mm. Here, the anode 60 may be formed on an extension of the second flange section 13C of the welded electrode 13 beforehand such that the welded electrode 13 can also serve as the anode 60.

Figure 5:
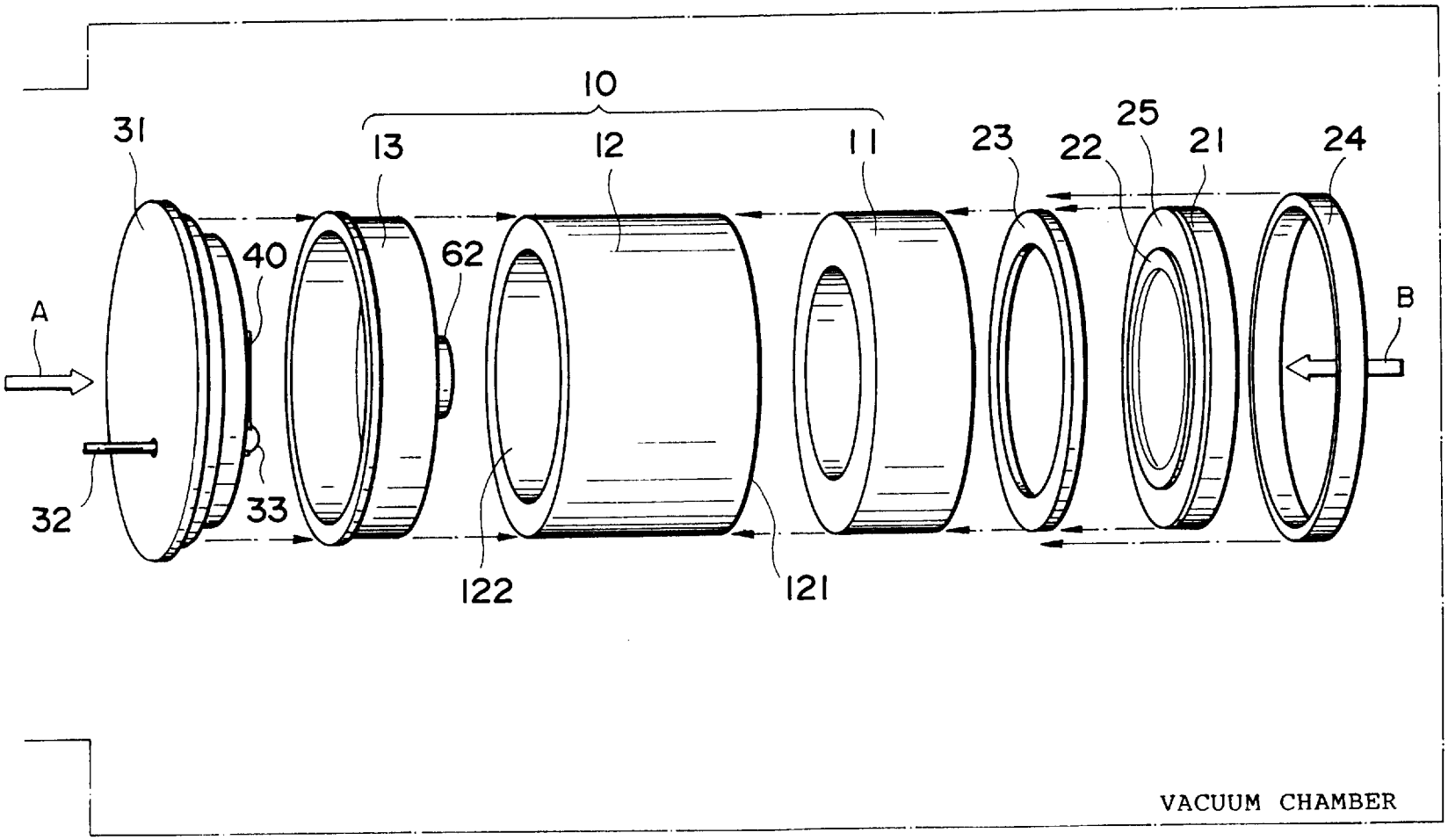
FIG. 5 is a view for explaining an assembling process of the electron tube in accordance with the present invention (first embodiment)

In the following, an assembling process for the electron tube 1 (first embodiment) will be explained with reference to FIG. 5. First, the semiconductor device 40 is die-bonded to the stem 31. Subsequently, the electrode 47 and the lead pin 32 are connected to each other by the wire 33. On the other hand, the anode 60 is secured to the welded electrode 13 in the case 10 by resistance welding, and the welded electrode 13 and the stem 31 are secured to each other by resistance welding. Then, the face plate 21, the indium ring 23, and the case 10, in which the stem 31 and the cathode electrode 11 are integrated together, are separately introduced into a vacuum apparatus (vacuum chamber) which is known as a transfer apparatus. Then, after being baked in a vacuum chamber for about 10 hours at 300° C., one side of the face plate 21 is provided with the photocathode 22. In order to form the photocathode 22, after vapor deposition of antimony, vapors of potassium, sodium, and cesium are successively introduced. Alternatively, it may be formed when cesium vapor and oxygen are alternately introduced onto a GaAs crystal which has been integrated with the face plate 21 beforehand.

The case 10 and the face plate 21 already provided with the photocathode 22 are joined together by way of the indium ring 23. As a pressure of about 100 kg is applied to this assembly (to the face plate 21 and the stem 31 in the directions indicated by arrows A and B in FIG. 11), the indium ring 23, which is the softest member therein, is crushed. Here, the gap between the face plate 21 and the cathode electrode 11, in which the indium ring 23 is positioned, is sealed with the auxiliary ring 24. As a result, the indium ring 23 functions as an adhesive. Accordingly, as the inside of the apparatus is kept in a vacuum state, a vacuum is produced in the electron tube 1. Finally, the vacuum in the transfer apparatus is caused to leak out, thereby accomplishing a series of steps. Typically, in the making of the electron tube 1 in the transfer apparatus, materials for about 50 pieces of electron tubes are set at once to make the photocathode 22. Accordingly, in such a method, a large amount of electron tubes 1 can be made homogeneously at a low cost.

As shown in FIGS. 2 and 3, in the electron tube 1, a voltage of −8 kV is applied to the photocathode 22 and the cathode electrode 11, whereas the anode 60 is supplied with 0 V (grounded). Here, the cathode electrode 11 and the anode 60 cooperate to form an electron lens. The photoelectrons emitted from the photocathode 22 having an effective diameter of 8 mm are reduced, in terms of their extent, to a diameter of 2 mm, which is smaller than the inner diameter of the collimator section 62, and then are guided onto the electron entrance surface 44*a* of the semiconductor device 40. On the other hand, in order to apply a reverse bias to the pn junction in the semiconductor device 40, a voltage of −150 V is applied to the breakdown-voltage control layer (anode) 44 of the semiconductor device 40, whereas the silicon substrate (cathode) 41 is supplied with 0 V (grounded). Accordingly, an avalanche-multiplying gain of about 50 times is obtained in the APD.

When light is incident on the electron tube 1, a photoelectron is emitted from the photocathode 22 into the vacuum. Thus emitted photoelectron is accelerated and converged by the electron lens, so as to be made incident on the electron entrance surface 44*a* of the APD 40 with an energy of 8 kev. As this photoelectron generates one piece of electron-hole pair each time it loses 3.6 eV of energy within the APD 40, it is multiplied by about 2,000 in this initial multiplying step and then by 50 in the subsequent avalanche multiplication, thereby yielding a gain of about $1\times10^5$ in total.

The initial multiplication factor of the electron tube 1 is about 2,000, which is higher than that of the typical photomultiplier by about three digits, thereby enabling detection with a very high S/N. In practice, when about four electrons on average are emitted from the photocathode 22 in response to very weak pulse light incident thereon, the number of input photoelectrons (number of incident photons) that has been indistinguishable by the conventional PMT becomes discernible. Such a characteristic obtained by the above-mentioned electron tube 1 is quite effective for quantitatively observing fluorescence emitted from a trace biomaterial. Also, it is quite important for the electron tube itself to stably operate over a long period of time.

In the electron tube 1 in accordance with the first embodiment, a voltage of −150 V is applied from a power supply to the electron entrance surface 44*a* of the semiconductor device 40 by way of the lead pin 32, the wire 33, and the entrance surface electrode 47. On the other hand, a voltage of 0 V is applied to the anode 60 by way of the welded electrode 13. Namely, the anode 60 has a positive potential with respect to the electron entrance surface 44 of the semiconductor device 40. Consequently, the positive ion generated at the electron entrance surface 44*a* is subjected to a reverse bias, whereby thus generated positive ion cannot return to the photocathode 22 or the case 10 through the opening section 61 of the anode 60.

Namely, since the anode 60 is kept at a positive potential with respect to the electron entrance surface 44*a*, i.e., at a reverse potential with respect to the positive ion generated at the electron entrance surface 44*a*, such a positive ion generated at the electron entrance surface 44*a* cannot return to the photocathode 22 or the insulating portion in the body 12 of the case beyond the anode 60. Accordingly, the photocathode 22 of the electron tube 1 is not influenced by such ion feedback and therefore does not deteriorate upon long-time operations. Further, since the positive ion does not return to the insulating portion of the case 10 either, the latter is prevented from being charged. Thus, the positive ion neither influences the orbit of electrons, which are emitted from the photocathode 22 so as to reach the semiconductor device 40, nor emits secondary electrons from the case 10 to generate pseudo signals. Accordingly, the electron tube realizes a quite stable operation over a long period of time.

Here, supposing that the ions generated at the electron entrance surface 44*a* of the semiconductor device 40 return to the photocathode 22, since the positive ion returns to the photocathode 22 with an energy as high as about 8 keV due to the potential difference between the photocathode 22 and the electron entrance surface 44*a*, the material constituting the photocathode 22 is sputtered with the positive ion. Accordingly, under the circumstances where the ions generated at the electron entrance surface 44*a* return to the photocathode 22, the photocathode sensitivity may remarkably deteriorate even in a short-time operation.

In the following, with reference to FIGS. 6 and 7, the configuration of an electron tube 100 in accordance with a second embodiment of the present invention will be explained. Hereinafter, while its differences from the first embodiment will be explained, the constituent parts in the drawings identical or equivalent to those of the electron tube 1 in accordance with the first embodiment will be referred to with the marks identical thereto without their overlapping explanations repeated. Also, the assembling process for the electron tube 100 in accordance with the second embodiment is similar to that in the first embodiment shown in FIG. 5.

Figure 6:
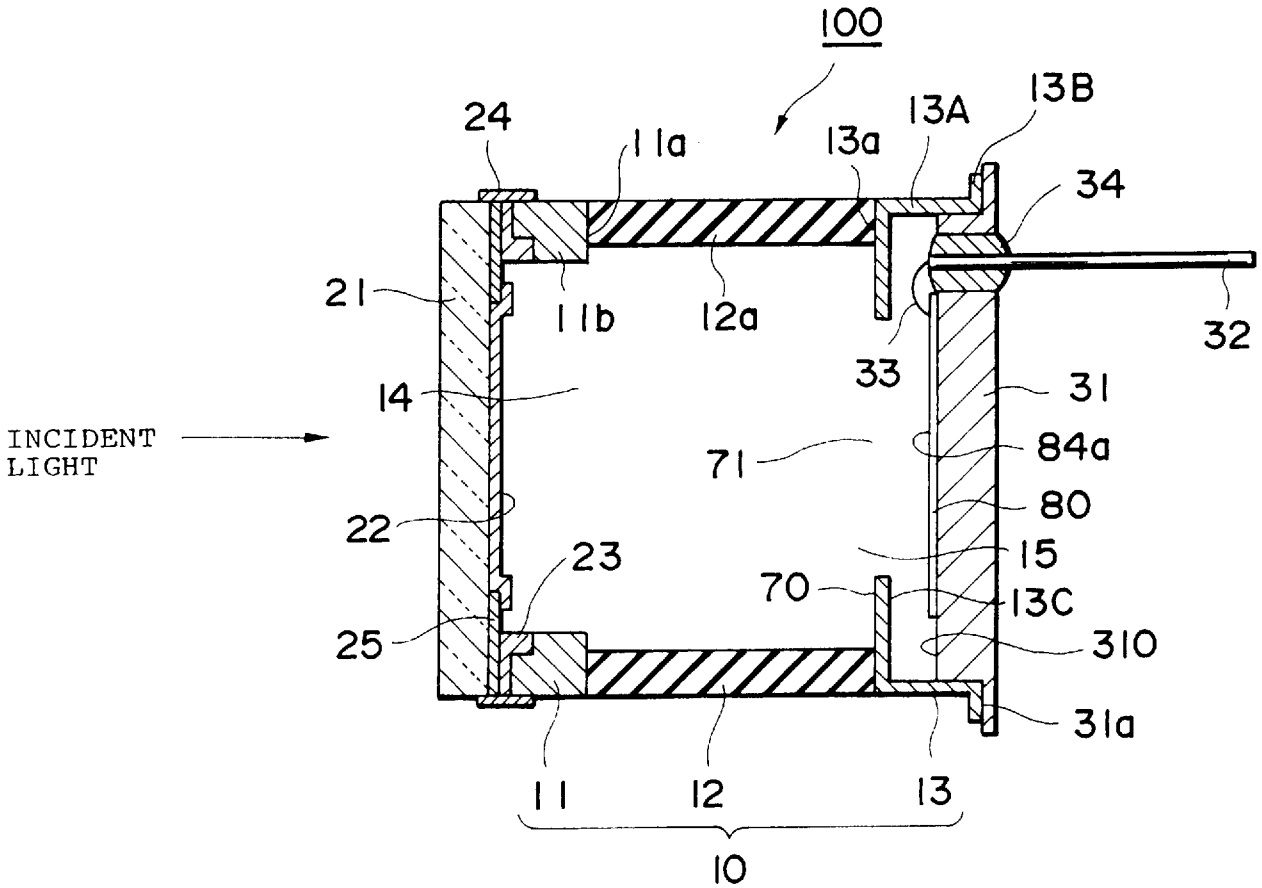
FIG. 6 is a cross-sectional view showing the configuration of the electron tube in accordance with a second embodiment of the present invention, at a cross section corresponding to that taken along line I—I shown in FIG. 2.

As shown in FIG. 6, the electron tube 100 differs from the electron tube 1 in that the length of the cathode electrode 11 is 2 mm, the length of the body 12 is 8 mm, the diameter of an opening section 71 of an anode 70 is 7 mm, and a PD (photodiode) is employed as a semiconductor device 80. In this embodiment, the operation of the electron lens is changed as the length of the cathode electrode 11 is altered, whereby the extent of the electrons emitted from the photocathode 22 having an effective diameter of 8 mm is converged to a diameter of about 5 mm and made incident on the semiconductor device 80. Further, the anode 70 (part of the welded electrode 13) is formed on an extension of the second flange section 13C of the welded electrode 13 beforehand such that the welded electrode 13 can also serve as the anode 70.

Thus configured electron tube 100 is supposed to be usable in a strong magnetic field exceeding 1 T (tesla) as well. In such a strong magnetic field, the advancing direction of electrons is determined by the direction of the magnetic field alone, and the electric field can be used only for accelerating the electrons. Namely, in such a strong magnetic field, no electron lens formed by the electric field can operate. Accordingly, the substantial effective diameter of the photocathode 22 is restricted by the size of an electron entrance surface 84*a* of the semiconductor device 80. Thus, in order to keep the effective diameter of the photocathode 22 as large as possible, the semiconductor device 80 having the large electron entrance surface 84*a* is required.

Figure 7:
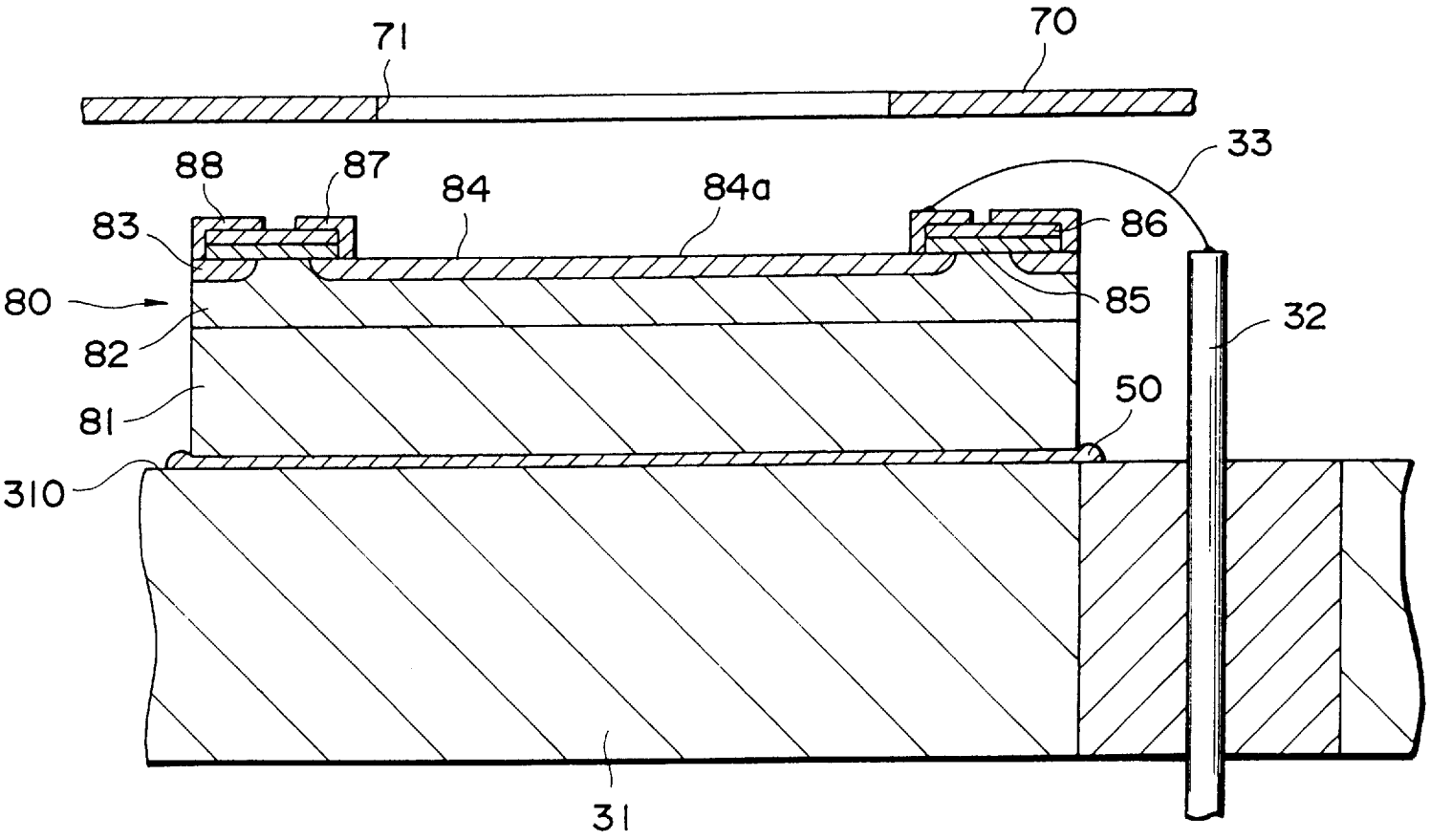
FIG. 7 is a view showing a cross-sectional configuration of a semiconductor device (PD) in the electron tube in accordance with the second embodiment shown in FIG. 6.

As shown in FIG. 7, the semiconductor device 80, i.e., PD, comprises a diffusion wafer as its substrate 82, in which phosphorus, i.e., an n-type impurity, is deeply dispersed with a high concentration into a high-resistance n-type wafer from the rear side thereof. A high concentration of phosphorus is ion-implanted into the peripheral portion of the surface of the substrate 82, whose rear side has become an n-type high-concentration contact layer 81, so as to form an n-type channel stop layer 83. A high concentration of boron is diffused into the surface of the substrate 82 at the center portion so as to form a disk-shaped p-type entrance surface layer (breakdown-voltage control layer) 84. Formed at the peripheral portion of the entrance surface layer 84 are an oxide film 85 and a nitride film 86 which cover the surface of the channel stop layer 83. Further, disposed in contact with the entrance surface layer 84 is an entrance surface electrode 87 made of an aluminum film for supplying a voltage to the entrance surface layer 84. At a position distanced from the entrance surface electrode 87 is an antistatic electrode 88 made of an aluminum film in contact with the channel stop layer 83. The electron entrance surface 84*a* of the PD 80 is substantially defined by the inner diameter of the entrance surface electrode 87. Preferably, the diameter of the electron entrance surface 84*a* is 7.2 mm.

Here, in the electron tube 100, a voltage of −8 kV is applied to the photocathode 22 and the cathode electrode 11, whereas 0 V is applied to the anode 70. At this time, the cathode electrode 11 and the anode 70 cooperate to form an electron lens. The photoelectrons emitted from the photocathode 22 having an effective diameter of 8 mm are reduced, in terms of their extent, to a diameter of 5 mm, which is smaller than the inner diameter of the opening section 71 of the anode 70, and then are guided onto the electron entrance surface 84*a* of the semiconductor device 80, i.e., PD. On the other hand, in order to apply a reverse bias to the pn junction of the PD 80, a voltage of −50 V is applied to its anode side, whereas 0 V is applied to its cathode side.

When light is incident on thus configured electron tube 100, a photoelectron is emitted from the photocathode 22 into the vacuum (within the electron tube 100). Through the electron lens formed by the cathode electrode 11 and anode 70, thus emitted photoelectron is accelerated with its orbit converged. After passing through the opening section 71 of the anode 70, the photoelectron is made incident on the PD 80 with an energy of 8 keV. As this photoelectron generates one piece of electron-hole pair each time it loses 3.6 eV of energy within the PD 80, it is multiplied by about 2,000, which becomes the gain of the electron tube 100.

The electron tube 100 mentioned above, in which the face plate 21 has a large light-receiving surface, can stably operate in a strong magnetic field and can be employed in high-energy experiments using an accelerator. In an example of such experiments, 10,000 pieces of electron tubes are disposed within an experimental apparatus generating a strong magnetic field of 4 T (tesla) so as to capture light emitted by a scintillator. When a number of electron tubes are arranged in a limited space for the experiment, it is important for the electron tubes to have a small size and uniform characteristics. Since the electron tube 100 adopts a vacuum seal technique employing the indium ring 23, it can be made with a small size. Also, since a large number of the electron tubes 100 can be made at once in a transfer apparatus, homogenous electron tubes having uniform characteristics in terms of sensitivity of the photocathode 22 and the like can be realized.

Further, in the electron tube 100, since there is no shielding member blocking the photoelectron emitted from the photocathode 22, a large effective diameter can be obtained even in a strong magnetic field. In general, in a strong magnetic field of about 4 T, no electron lens made by an electric field can operate, whereby the photoelectron emitted from the photocathode 22 cannot be converged into a small area by means of an electric field. Accordingly, in the electron tube 100 which is tolerant to such a use, the photocathode 22 having an effective diameter of 8 mm and the semiconductor device 80 having the electron entrance surface 84*a* with an effective diameter of 7.2 mm which is substantially equivalent to the former are disposed, whereas only the anode 70 (part of the welded electrode 13) having the opening section with a diameter of 7 mm is disposed therebetween. When the electron tube 100 is operated in a strong magnetic field of 4 T having the same direction as the incident light (coinciding with AX shown in FIG. 2), the photoelectron emitted from the center region of the photocathode 22 (portion with a diameter of 7 mm) is made incident on the semiconductor device 80 without being blocked. Accordingly, in the electron tube 100, an effective diameter of 7 mm can be obtained in a strong magnetic field. It is needless to mention that a typical photomultiplier (PMT) cannot be used in such a strong magnetic field.

Figure 8:
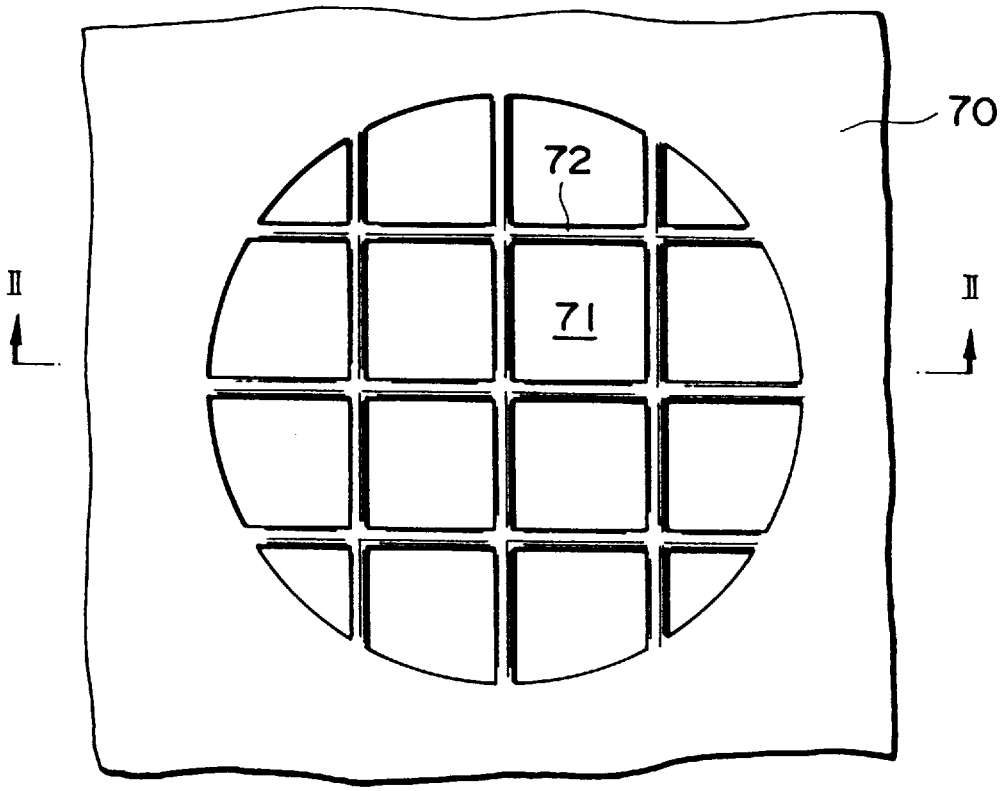
FIG. 8 is a plan view showing a modified example of an anode in the electron tube in accordance with the second embodiment shown in FIG. 6.
Figure 9:
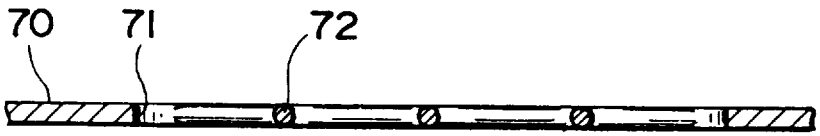
FIG. 9 is a cross-sectional view showing the configuration of the anode taken along line II—II in FIG. 8.

The present invention should not be restricted to the foregoing embodiments. For example, in the electron tube 100 in accordance with the second embodiment, as shown in FIGS. 8 and 9, a grid-shaped mesh electrode 72 can be disposed at the opening section 71 of the anode 70 (part of the welded electrode 13). In order to form the mesh electrode 72, the anode 70 made of stainless is partially etched. In this case, the line width and pitch of the mesh electrode 72 are 50 microns and 1.5 mm, respectively. Electrons are transmitted through the mesh electrode 72 at a rate corresponding to the open area ratio ($93\% \approx (1.5-0.05)^2/(1.5)^2 \times 100$) of the mesh electrode 72.

The mesh electrode 72 is disposed at the opening section 71 of the anode 70 since the opening section 71 of the anode 70 is increased in view of the electron entrance surface 84*a* of the semiconductor device 80. Namely, it is due to the fact that, when the opening section 71 of the anode 70 is made large, the valley of minus potential on the side of the photocathode 22 penetrates through the anode 70 from the opening section 71, thereby lowering the effect for suppressing the feedback of the positive ion generated at the electron entrance surface 84*a* of the semiconductor device 80. When the mesh electrode 72 is additionally provided, the minus potential from the photocathode 22 can be prevented from intruding into the electron entrance surface 84, whereby the effect for suppressing the ion feedback can be maintained. Here, the maximum diameter of the opening section 71 of the anode 70 is smaller than the electron entrance surface 84*a* of the PD 80.

As explained in the foregoing, in accordance with the present invention (first and second embodiments), the case is configured to comprise a ring-shaped cathode electrode integrally made of a conductive material, which is disposed on the photocathode side so as to form, together with an anode, an electron lens for irradiating a semiconductor device with an electron emitted from the photocathode, and is connected to a face plate by way of a bonding member made of indium or the like; a ring-shaped welded electrode, positioned on the stem side, having an outer end secured to the stem; and a ring-shaped body made of an electrical insulating material, positioned between the cathode electrode and the welded electrode, having one end secured to an end face of the cathode electrode and the other end secured to an end face of the welded electrode; while they are mounted on each other with their center axes coinciding with each other. With this configuration, an electron tube can be made smaller such that a number of electron tubes can be arranged densely within a limited narrow space, and an electron tube with a very high workability in its assembling process can be obtained.

Figure 10:
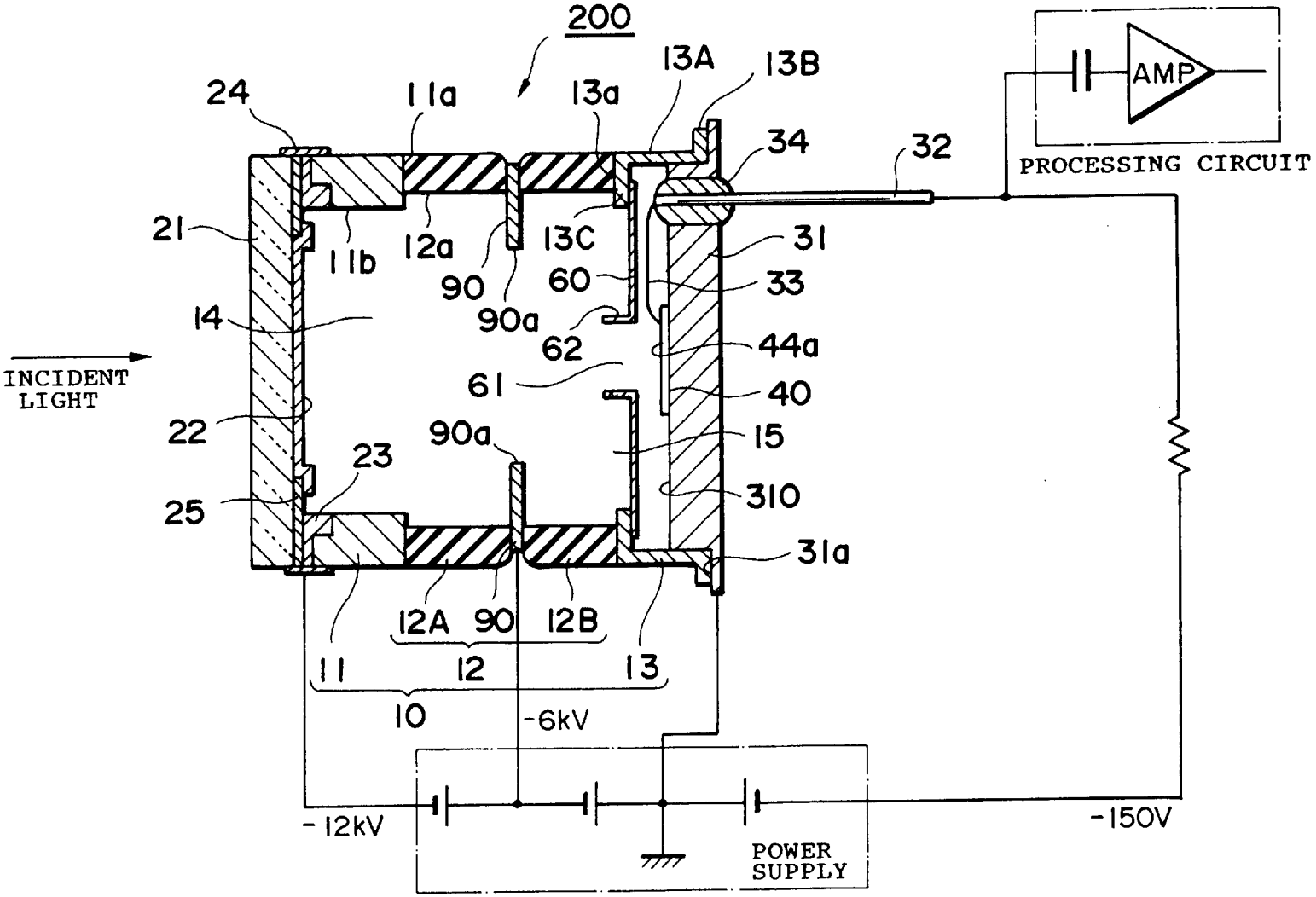
FIG. 10 is a cross-sectional view showing the configuration of the electron tube in accordance with a third embodiment of the present invention, at a cross section corresponding to that taken along line I—I shown in FIG. 2.

In the following, with reference to FIGS. 10 to 12, the configuration and assembling process of electron tubes in accordance with the present invention (third and fourth embodiments) will be explained. Here, the configuration and assembling process of an electron tube 200 in accordance with the third embodiment shown in FIG. 10 are identical to those of the electron tube 1 in accordance with the first embodiment except for the structure and assembling step of the body 12. Also, the configuration and assembling process of an electron tube 300 in accordance with the fourth embodiment are identical to those of the electron tube 100 in accordance with the second embodiment except for the structure and assembling step of the body 12.

FIG. 10 is a cross-sectional view showing the configuration of the electron tube 200 in accordance with the third embodiment of the present invention. As depicted, the electron tube 200 has the cylindrical case 10. The case 10 is constituted by the ring-shaped cathode electrode 11, which is made of a highly conductive covar metal by any of various integral-molding methods such as press molding, injection molding, or cutting; the ring-shaped body 12 made of an electrical insulating material (e.g., ceramics); and the ring-shaped welded electrode 13 made of a covar metal. The body 12 further comprises a first bulb (insulating member) 12A, a second bulb (insulating member) 12B, and a ring-shaped intermediate electrode 90 made of a covar metal held and secured between the insulating members 12A and 12B. The members 11, 12 (including the members 12A, 12B, and 90), and 13 are mounted on each other with their center axes coinciding with each other. While the body 12 including the intermediate electrode 90 is disposed between the cathode electrode 11 and the welded electrode 13, one end of the body 12 (on the side of the first opening 14) is butted against the flat end face 11*a* of the cathode electrode 11 and then is secured thereto by brazing or the like. The other end of the body 12 (on the side of the second opening 15) is butted against the flat end face 13*a* of the welded electrode 13 and then is secured thereto by brazing or the like. In order to form the body 12, the outer peripheral end portion of the intermediate electrode 90 is held between the first bulb 12A and the second bulb 12B, and their joint portions are brazed. Thus, the case 10 can easily be united by brazing.

As with the above-mentioned first and second embodiments, the ring-shaped cathode electrode 11, the body 12 (including the bulbs 12A and 12B and the intermediate electrode 90), and the welded electrode 13 may have a polygonal cross-sectional form.

The inner peripheral wall face 11*b* of the cathode electrode 11 and the inner wall face 12*a* of the first and second bulbs 12A and 12B each have a circular cross-sectional form. The inner diameters of the cathode electrode 11 and body 12 are respectively 10 mm and 11 mm, for example. Here, the through-holes 11*b* and 12*a* may have either identical or different cross-sectional forms and may be either circular or polygonal. Preferably, in the third embodiment, the lengths of the cathode electrode 11, first bulb 12A, and second bulb 12B are 3.5 mm, 3.5 mm, and 3 mm, respectively.

Here, the intermediate electrode 90 projects inward from the inner peripheral wall face 12*a* of the first and second bulbs 12A and 12B, while the inner diameter of an opening section 90*a* of the intermediate electrode 90 is minimized (preferably 7 mm) within a range which does not interfere with the electron orbit. Accordingly, the insulating members 12A and 12B are prevented from being charged with stray electrons. Also, even when the insulating members 12A and 12B are charged for some reason, the potential in a space near the electron orbit is made constant by means of the intermediate electrode 90, whereby the charge of the insulating members 12A and 12B can be prevented from affecting the electron orbit. Preferably, the thickness of the intermediate electrode 90 is 0.5 mm.

Firmly attached to the cathode electrode 11 in the case 10 is the face plate 21 made of glass which transmits light therethrough. The face plate 21 has the photocathode 22 on the inner face and is disposed at one end of the body 12 on the side of the first opening 14. After the photocathode 22 is made, the face plate 21 is integrated with the cathode electrode 11 by way of the bonding member (bonding ring) 23 made of a metal material selected from the group consisting of In, Au, Pb, alloys containing In, and alloys containing Pb. Disposed at the peripheral portion of the photocathode 22 is the electrode 25 made of a thin film of chromium for electrically connecting together the photocathode 22 and the bonding member 23 (referred to as "indium ring" hereinafter) containing indium. The inner diameter of the electrode 25, i.e., 8 mm, defines the effective diameter of the photocathode 22. The indium ring 23 is formed so as to project from the inner side face of the hollow cylindrical auxiliary member 24. When the indium ring 23 and the face plate 21 are successively disposed on the cathode electrode 11, and then the cathode electrode 11 and the face plate 21 are pressed against each other at a high pressure of about 100 kg, the indium ring 23 deforms and functions as an adhesive, whereby the face plate 21 is integrated with the case 10.

Firmly attached to the welded electrode 13 in the case 10 is the disk-shaped stem 31 made of a conductive material (e.g., covar metal). The stem 31 is disposed at the other end of the case 10 (on the side of the second opening 15 in the body 12). As with the above-mentioned first and second embodiments, the welded electrode 13 comprises the cylindrical main part 13A; the circular first flange section 13B, positioned at one end of the cylindrical main part 13A, projecting outward so as to be utilized for joining with the stem 31; and the circular second flange section 13C, positioned at the other end of the cylindrical main part 13A (on the body side), projecting inward so as to be utilized for joining with the body 12. Formed at the outer periphery of the stem 31 is the circular cutout edge section 31*a* to be secured to the first flange section 13B.

Further, disposed on the mounting surface 310 of the stem 31 in the electron tube 200 in accordance with the third embodiment is the semiconductor device 40 having the same configuration as that of the APD (avalanche photodiode) in the first embodiment (see FIG. 4). Preferably, the diameter of the electron entrance surface 44*a* on the inside of the entrance surface electrode 47 is 3 mm.

As shown in FIGS. 4 and 10, the planar anode 60 is disposed between the semiconductor device 40 and the intermediate electrode 90, and the outer peripheral end portion of the anode 60 is secured to the second flange section 13C of the welded electrode 13. This configuration is similar to that in the electron tube 1 in the above-mentioned first embodiment. The anode 60 is formed by a pressed thin stainless sheet having a thickness of 0.3 mm. Preferably, the distance between the anode 60 and the semiconductor device 40 is 1 mm.

In the following, the assembling process for the electron tube 200 in accordance with the third embodiment will be explained with reference to FIG. 11. This assembling process is the same as the assembling process (FIG. 5) for the electron tubes 1 and 100 in accordance with the first and second embodiments explained earlier, except for the assembling step of the body 12.

Figure 11:
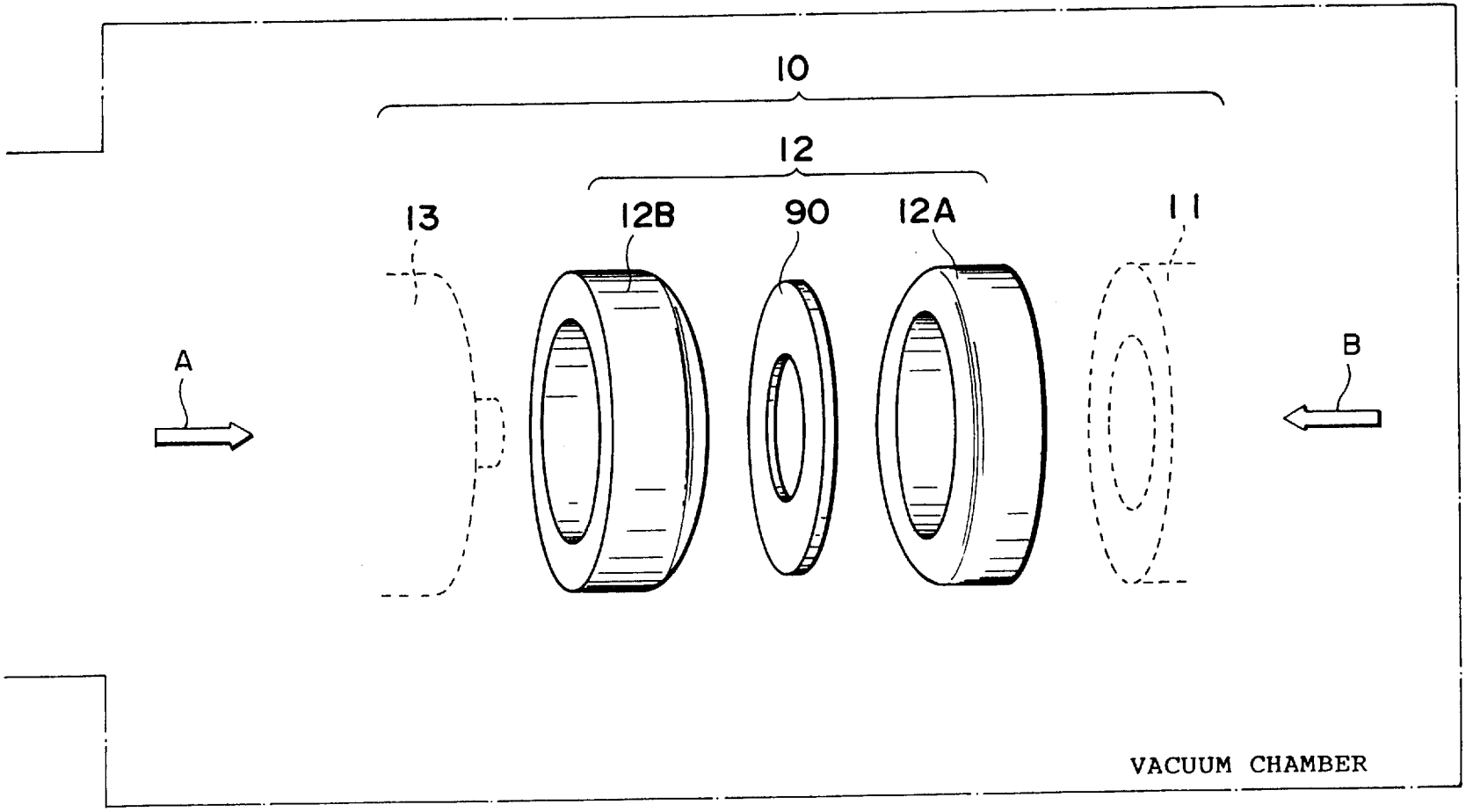
FIG. 11 is a view for explaining an assembling process of the electron tube in accordance with the present invention (third embodiment)

In the transfer apparatus (vacuum chamber), the case 10 (including the cathode electrode 11, first and second bulbs 12A and 12B, intermediate electrode 90, and welded electrode 13) and the face plate 21 are joined together by way of the indium ring 23, and a pressure of about 100 kg is applied to thus formed assembly (to the face plate 21 and the stem 31 in the directions indicated by arrows A and B in FIG. 11), whereby the indium ring 23, which is the softest member therein, is crushed. As a result, the indium ring 23 functions as an adhesive. Accordingly, as the inside of the apparatus is kept in a vacuum state, a vacuum is produced in the electron tube 200. Finally, the vacuum in the transfer apparatus is caused to leak out, thereby accomplishing a series of steps.

As shown in FIG. 10, in the electron tube 200, a voltage of −12 kV is applied to the photocathode 22 and the cathode electrode 11, the anode 60 is supplied with 0 V (grounded), and their in-between voltage of −6 kV is applied to the intermediate electrode 90. Here, the cathode electrode 11, the anode 60, and the intermediate electrode 90 cooperate to form an electron lens. Accordingly, the photoelectrons emitted from the photocathode 22 having an effective diameter of 8 mm are reduced, in terms of their extent, to a diameter of 2 mm, which is smaller than the inner diameter of the collimator section 62, and then are guided onto the electron entrance surface 44*a* of the semiconductor device 40. On the other hand, as in the case of the above-mentioned first embodiment, in order to apply a reverse bias to the pn junction in the semiconductor device 40, a voltage of −150 V is applied to the breakdown-voltage control layer (anode) 44 of the semiconductor device 40, whereas the silicon substrate (cathode) 41 is supplied with 0 V (grounded). Accordingly, an avalanche-multiplying gain of about 50 times is obtained in the APD. Here, a method of applying a predetermined voltage, which is not lower than the voltage applied to the photocathode 22 but not greater than the voltage applied to the anode 60, to the intermediate electrode 90 can be realized with a Cockcroft-Walton power supply. Alternatively, the applied voltage may be divided by means of a resistance.

When light is incident on the electron tube 200 in accordance with the third embodiment, a photoelectron is emitted from the photocathode 22 into the vacuum (within the electron tube 200). Through the electron lens, thus emitted photoelectron is accelerated with its orbit being converged, so as to be made incident on the electron entrance surface 44*a* of the APD 40 with an energy of 12 keV. As this photoelectron generates one piece of electron-hole pair each time it loses 3.6 eV of energy within the APD 40, it is multiplied by about 3,000 in this initial multiplying step and then by 50 in the subsequent avalanche multiplication, thereby yielding a gain of about $2\times10^5$ in total.

In addition to the effects similar to those of the above-mentioned first embodiment, the electron tube 200 in accordance with the third embodiment yields the specific effects as will be explained hereinafter. In typical electron tubes, bulbs made of an insulating material may be charged under the influence of stray electrons, ions, or X-rays. The charge of the inner peripheral wall face may trigger dielectric breakdown.

In the electron tube 200 in accordance with the third embodiment, by contrast, the body 12 is divided into two pieces of the first and second bulbs 12A and 12B made of ceramics, whereas the intermediate electrode 90 is inserted between the first and second bulbs 12A and 12B. Since a predetermined voltage between the voltages respectively applied to the photocathode 22 and the anode 60 is applied to the intermediate electrode 90, no dielectric breakdown occurs even when a strong negative voltage is applied to the photocathode 22. Also, since the intermediate electrode 90 is inserted between the first and second bulbs 12A and 12B made of ceramics, the insulating parts (first and second bulbs 12A and 12B) are hard to be charged with stray electrons, ions, X-rays, or the like. Further, since the intermediate electrode 90 is set to a middle potential, dielectric breakdown will not occur in the first and second bulbs 12A and 12B even if these insulating parts are charged. Accordingly, in the electron tube 200, a high gain can be obtained even when a strong negative voltage is applied to the photocathode 22.

Here, the opening section 90*a* of the intermediate electrode 90, which is set to a middle potential, has such a minimum size that does not interfere with the electron orbit and is set to the potential of a space near the electron orbit, whereby the influence of the charge in the inner peripheral wall face 12*a* of each of the first and second bulbs 12A and 12B upon the electron orbit can be suppressed.

In the electron tube 200 in accordance with the third embodiment, as with the electron tube 1 in the first embodiment, a voltage of −150 V is applied to the electron entrance surface 44*a* of the semiconductor device 40, whereby the electron entrance surface 44*a* is kept at a negative potential with respect to the anode 60. Accordingly, regarding to the ion feedback, the effects similar to those of the above-mentioned first embodiment can also be obtained by the electron tube 200 in accordance with the third embodiment.

In the following, the configuration of the electron tube 300 in accordance with the fourth embodiment of the present invention will be explained with reference to FIG. 12. Hereinafter, while its differences from the third embodiment will be explained, the constituent parts in the drawing identical or equivalent to those of the electron tubes 1, 100, and 200 in accordance with the first to third embodiments will be referred to with the marks identical thereto without their overlapping explanations repeated. Also, the configuration and assembling process of the electron tube 300 in accordance with the fourth embodiment are identical to those of the electron tube 100 in accordance with the second embodiment except for the structure and assembling step of the body 12. Further, the semiconductor device 80 in the electron tube 300 in accordance with the fourth embodiment has the configuration shown in FIG. 7.

Figure 12:
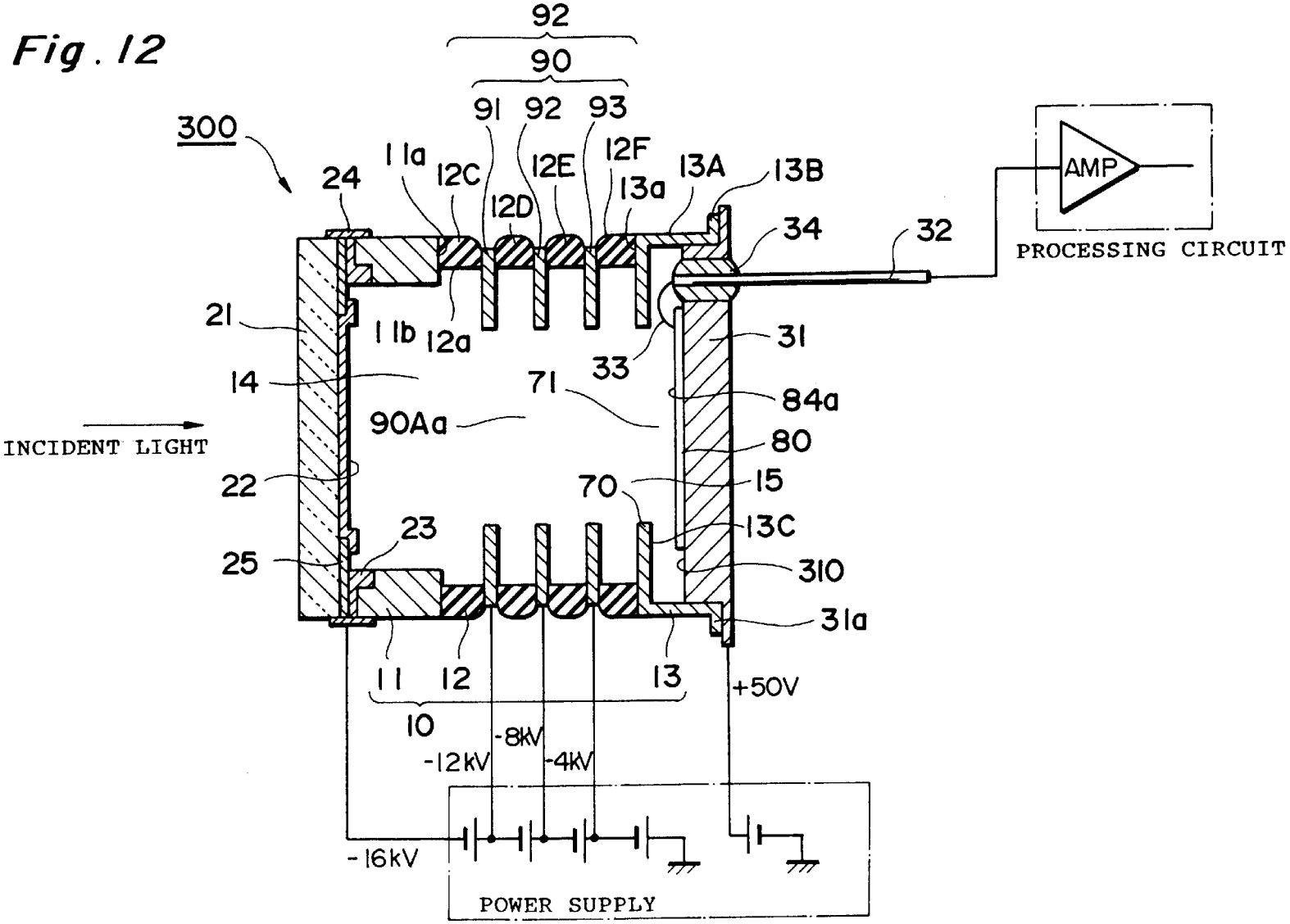
FIG. 12 is a cross-sectional view showing the configuration of the electron tube in accordance with a fourth embodiment of the present invention, at a cross section corresponding to that taken along line I—I shown in FIG. 2.

As shown in FIG. 12, the electron tube 300 differs from the electron tube 200 of the third embodiment in that the cathode electrode has a length of 2 mm, the body is divided into four pieces of first to fourth bulbs (insulating members) 12C to 12F, three sheets of first to third disk electrodes 91 to 93 (included in the intermediate electrode 90) are successively held between the bulbs 12C to 12F, and a PD (photodiode) is employed as the semiconductor device 80. In this embodiment, the operation of the electron lens is changed as the length of the cathode electrode 11 is altered, whereby the extent of the photoelectrons emitted from the photocathode 22 having an effective diameter of 8 mm is converged to a diameter of about 5 mm and made incident on the semiconductor device 80. Further, the anode 70 (part of the welded electrode 13) is formed on an extension of the second flange section 13C of the welded electrode 13 beforehand such that the welded electrode 13 can also serve as the anode 70.

As with the electron tube 100 in accordance with the second embodiment, thus configured electron tube 300 of the fourth embodiment is supposed to be usable in a strong magnetic field exceeding 1 T (tesla) as well. Since no electron lens formed by the electric field can operate in such a strong magnetic field, the substantial effective diameter of the photocathode 22 is restricted by the size of the electron entrance surface 84*a* of the semiconductor device 80. Thus, in order to keep the effective diameter of the photocathode 22 as large as possible, the semiconductor device 80 having the large electron entrance surface 84*a* is required.

The configuration of the semiconductor device 80 employed in the electron tube 300 in accordance with the fourth embodiment is shown in FIG. 7 (as in the case of the second embodiment). The electron entrance surface 84*a* of the PD 80 is substantially defined by the inner diameter of the entrance surface electrode 87 and preferably has a diameter of 7.2 mm.

Here, in the electron tube 300, a voltage of −16 kv is applied to the photocathode 22 and the cathode electrode 11, whereas a voltage of +50 V is applied to the anode 70. Respectively applied to the first to third disk electrodes 91 to 93 are predetermined voltages, between the photocathode 22 and the anode 70, of −12 kV, −8 kV, and −4 kV. At this time, the cathode electrode 11, the anode 70, and the intermediate electrode 90 cooperate to form an electron lens. The photoelectrons emitted from the photocathode 22 having an effective diameter of 8 mm are reduced, in terms of their extent, to a diameter of 5 mm, which is smaller than the inner diameter of the opening section 71 of the anode 70, and then are guided onto the electron entrance surface 84*a* of the semiconductor device 80, i.e., PD. On the other hand, a reverse bias is applied to the PD 80, such that a voltage of +50 V is applied to its cathode side by way of the stem 31, whereas the ground potential of an external circuit (processing circuit) is applied to its anode side by way of the lead pin 32 and the wire 33. Also, a DC signal component is outputted from the lead pin 32.

When light is incident on thus configured electron tube 300, a photoelectron is emitted from the photocathode 22 into the vacuum (within the electron tube 300). Through the electron lens formed by the cathode electrode 11, intermediate electrode 90, and anode 70, thus emitted photoelectron is accelerated with its orbit converged. After passing through an opening section 90A*a* of the intermediate electrode 90 and the opening section 71 of the anode 70, the photoelectron is made incident on the PD 80 with an energy of 16 kev. As this photoelectron generates one piece of electron-hole pair each time it loses 3.6 eV of energy within the PD 80, it is multiplied by about 4,000, which becomes the gain of the electron tube 300.

The body 12 is divided into four pieces of the ceramic bulbs 12C to 12F by way of the intermediate electrode 90 (first to third disk electrodes 91 to 93). Predetermined voltages between the photocathode 22 and the anode 70 are respectively applied to the first to third disk electrodes 91 to 93. Accordingly, dielectric breakdown does not occur even when a strong negative voltage is applied to the photocathode 22, whereby a high implanting gain can be obtained. Further, since the intermediate electrode 90 is set to the potential in the space near the electron orbit, even when the inner peripheral wall face 12*a* of each of the bulbs 12C to 12F is charged, the electron orbit is not influenced thereby.

As with the second embodiment, the electron tube 300 in accordance with the fourth embodiment can also be employed in high-energy experiments using an accelerator. In general, in a strong magnetic field of about 4 T, no electron lens made by an electric field can operate, whereby the photoelectron emitted from the photocathode 22 cannot be converged into a small area by means of an electric field. Accordingly, as with the second embodiment, in the electron tube 300 of the fourth embodiment, which is tolerant to such a use, the photocathode 22 having an effective diameter of 8 mm and the semiconductor device 80 having the electron entrance surface 84*a* with an effective diameter of 7.2 mm which is substantially equivalent to the former are disposed, whereas only the anode 70 (part of the welded electrode 13) having the opening section with a diameter of 7 mm is disposed therebetween. When the electron tube 300 is operated in a strong magnetic field of 4 T having the same direction as the incident light (coinciding with AX shown in FIG. 2), the photoelectron emitted from the center region of the photocathode 22 (portion with a diameter of 7 mm) is made incident on the semiconductor device 80 without being blocked. Accordingly, in the electron tube 300, an effective diameter of 7 mm can be obtained in a strong magnetic field. It is needless to mention that a typical photomultiplier (PMT) cannot be used in such a strong magnetic field.

Further, in the electron tube 300 in accordance with the fourth embodiment, as with the second embodiment, as shown in FIGS. 8 and 9, the grid-shaped mesh electrode 72 can be disposed at the opening section 71 of the anode 70 (part of the welded electrode 13). In order to form the mesh electrode 72, the anode 70 made of stainless is partially etched. In this case, the line width and pitch of the mesh electrode 72 are 50 microns and 1.5 mm, respectively. Electrons are transmitted through the mesh electrode 72 at a rate corresponding to the open area ratio (93%) of the mesh electrode 72.

The mesh electrode 72 is disposed at the opening section 71 of the anode 70 since the opening section 71 of the anode 70 is increased in view of the electron entrance surface 84*a* of the semiconductor device 80. Namely, it is due to the fact that, when the opening section 71 of the anode 70 is made large, the valley of minus potential on the side of the photocathode 22 penetrates through the anode 70 from the opening section 70, thereby lowering the effect for suppressing the feedback of the positive ion generated at the electron entrance surface 84*a* of the semiconductor device 80. When the mesh electrode 72 is additionally provided, the minus potential from the photocathode 22 can be prevented from intruding into the electron entrance surface 84, whereby the effect for suppressing the ion feedback can be maintained. Here, the maximum diameter of the opening section 71 of the anode 70 is smaller than the electron entrance surface 84*a* of the PD 80. These effects are similar to those of the above-mentioned second embodiment.

As explained in the foregoing, in accordance with the present invention (third and fourth embodiments), the case is configured to comprise a ring-shaped cathode electrode integrally made of a conductive material, which is disposed on the photocathode side so as to form, together with an anode, an electron lens for irradiating a semiconductor device with a photoelectron emitted from the photocathode, and is connected to a face plate by way of a bonding member made of indium or the like; a ring-shaped welded electrode, positioned on the stem side, having an outer end secured to the stem; and a body made of an electrical insulating material, positioned between the cathode electrode and the welded electrode, having one end secured to an end face of the cathode electrode and the other end secured to an end face of the welded electrode. In this body, at least two insulating members and a ring-shaped intermediate electrode (including a plurality of disk electrodes) inserted between the insulating members are mounted on each other with their center axes coinciding with each other. With this configuration, an electron tube can be made smaller such that a number of electron tubes can be arranged densely within a limited narrow space, and an electron tube having a very high workability in its assembling process can be obtained.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

The basic Japanese Application No. 186387/1996 filed on Jul. 16, 1996 and No. 186392/1996 filed on Jul. 16, 1996 are hereby incorporated by reference.

What is claimed is:

1. An electron tube comprising:

a body having a first opening and a second opening opposing said first opening;

a face plate which is provided on the first opening side of said body and on which a photocathode for emitting an electron in response to incident light is provided;

a stem, provided on the second opening side of said body, for defining a distance between said photocathode and an electron entrance surface on which the electron emitted from said photocathode is incident;

a cathode electrode provided on the first opening side of said body and positioned between said body and said face plate, said cathode electrode having a through-hole for transmitting therethrough the electron from said photocathode toward said electron entrance surface; and a bonding member, disposed between said face plate and said cathode electrode, for bonding said face plate and said cathode electrode together, said bonding member being made of a metal material selected from the group consisting of In, Au, Pb, alloys containing In, and alloys containing Pb.

2. An electron tube according to claim 1, further comprising a conductive auxiliary member for sealing a gap between said cathode electrode and said face plate, said bonding member being positioned in said gap.

3. An electron tube according to claim 1, further comprising a welded electrode provided on the second opening side of said body and positioned between said body and said stem, said welded electrode having a through-hole for transmitting therethrough the electron transmitted through the through-hole of said cathode electrode toward said electron entrance surface.

4. An electron tube according to claim 3, further comprising an anode having a through-hole for transmitting therethrough the electron transmitted through said cathode electrode, said anode being supported by said welded electrode such that at least part of said anode is positioned between said cathode electrode and said electron entrance surface.

5. An electron tube according to claim 1, wherein the through-hole of said cathode electrode has an area smaller than that of each of said first and second openings.

6. An electron tube according to claim 3, wherein the through-hole of said welded electrode has an area smaller than that of said electron entrance surface.

7. An electron tube according to claim 4, wherein the through-hole of said anode has an area smaller than that of said electron entrance surface.

8. An electron tube according to claim 3, wherein said welded electrode has a portion to be resistance-welded to said stem.

9. An electron tube according to claim 1, further comprising a semiconductor device having said electron entrance surface, wherein said stem has a mounter section for holding said semiconductor device, said mounter section projecting toward said photocathode.

10. An electron tube according to claim 1, wherein said body comprises:

at least two insulating members each having a through-hole extending from said photocathode toward said electron entrance surface; and at least one conductive member provided between said insulating members adjacent to each other, said conductive member having a through-hole extending from said first opening toward said second opening.

11. An electron tube according to claim 10, wherein the through-hole of said conductive member has an area smaller than that of the through-hole of each of said insulating members.

12. An electron tube comprising:

a body having a first opening and a second opening opposing said first opening, said body comprising:

at least two insulating members each having a through-hole extending from said first opening toward said second opening, and at least one conductive member provided between said insulating members adjacent to each other, said conductive member having a through-hole extending from said first opening toward said second opening;

a face plate which is provided on the first opening side of said body and on which a photocathode for emitting an electron in response to incident light is provided;

a stem, provided on the second opening side of said body, for defining a distance between said photocathode and an electron entrance surface on which the electron emitted from said photocathode is incident;

a cathode electrode provided on the first opening side of said body and positioned between said body and said face plate, said cathode electrode having a through-hole for transmitting therethrough the electron from said photocathode toward said electron entrance surface; and a bonding ring, provided between said face plate and said cathode electrode, for bonding said face plate and said cathode electrode together, said bonding ring being made of a metal material selected from the group consisting of In, Au, Pb, alloys containing In, and alloys containing Pb.

13. An electron tube according to claim 12, further comprising a conductive auxiliary member for sealing a gap between said cathode electrode and said face plate, said bonding member being positioned in said gap.

14. An electron tube according to claim 12, further comprising a welded electrode provided on the second opening side of said body and positioned between said body and said stem, said welded electrode having a through-hole for transmitting therethrough the electron transmitted through the through-hole of said cathode electrode toward said electron entrance surface.

15. An electron tube according to claim 14, further comprising an anode having a through-hole for transmitting therethrough the electron transmitted through said cathode electrode, said anode being supported by said welded electrode such that at least part of said anode is positioned between said cathode electrode and said electron entrance surface.

16. An electron tube according to claim 12, wherein the through-hole of said cathode electrode has an area smaller than that of each of said first and second openings.

17. An electron tube according to claim 14, wherein the through-hole of said welded electrode has an area smaller than that of said electron entrance surface.

18. An electron tube according to claim 15, wherein the through-hole of said anode has an area smaller than that of said electron entrance surface.

19. An electron tube according to claim 14, wherein said welded electrode has a portion to be resistance-welded to said stem.

20. An electron tube according to claim 12, further comprising a semiconductor device having said electron entrance surface, wherein said stem has a mounter section for holding said semiconductor device, said mounter section projecting toward said photocathode.

21. An electron tube according to claim 12, wherein the through-hole of said conductive member has an area smaller than that of the through-hole of each of said insulating members.

* * * * *